United States Patent [19]

Schweim

[11] Patent Number: 4,746,045

[45] Date of Patent: May 24, 1988

[54] GOLF SCORECARD HOLDER

[76] Inventor: Donald E. Schweim, 411 Forest Heights, North Mankato, Minn. 56001

[21] Appl. No.: 15,688

[22] Filed: Feb. 17, 1987

[51] Int. Cl.[4] ..... B60R 9/08

[52] U.S. Cl. ..... 224/274; 224/269; 224/277

[58] Field of Search ..... 224/918, 269, 274, 277; 40/10 R, 11 R, 334, 904, 905, 915; 206/315.3, 315.5; 24/3 R, 3 F, 3 L; 229/71

[56] References Cited

U.S. PATENT DOCUMENTS

| | | | |
|---|---|---|---|
| 1,850,471 | 3/1932 | Norris | 224/277 X |
| 2,531,295 | 11/1950 | Ritchie | 224/277 X |
| 3,156,000 | 11/1964 | Westhoff | 224/274 X |
| 3,466,774 | 9/1969 | Borresen | 40/10 R |
| 3,539,204 | 11/1970 | Keller | 40/10 R X |
| 3,692,233 | 9/1972 | Carter, Jr. | 229/71 |
| 4,157,152 | 6/1979 | Blastic | 224/274 X |
| 4,259,798 | 4/1981 | McConnell | 40/10 R |
| 4,356,646 | 11/1982 | Johnson, Jr. | 40/10 R X |
| 4,573,610 | 3/1986 | Hurner | 224/918 X |
| 4,645,105 | 2/1987 | Plumbridge | 224/252 X |

FOREIGN PATENT DOCUMENTS

| | | | |
|---|---|---|---|
| 667961 | 8/1963 | Canada | 224/918 |

*Primary Examiner*—Henry J. Recla
*Assistant Examiner*—Robert Petrik
*Attorney, Agent, or Firm*—Herman H. Bains

[57] ABSTRACT

A golf scorecard holder is formed of rigid transparent plastic and is of generally rectangular-shaped configuration. One longitudinal edge portion of the golf scorecard holder is shaped to define a curved clamping element and a recess which is shaped in dimension to frictionally engage a pencil for use by a golfer. The other longitudinal edge portion of the holder is shaped to define a retaining lip. A clamping ring may be attached to either end of a holder and is attachable to a golf bag. A transparent envelope is clamped against the clamping surface of the holder by the clamping element to retain the transparent envelope against the clamping surface. The scorecard is positioned between the panels of the envelope for ready examination by a user. The envelope and scorecard may be readily removed from the holder by a user for entry of the golfer's score.

3 Claims, 1 Drawing Sheet

Hole
White Tee
Black Tee
Out
In

GOLF SCORECARD HOLDER

This invention relates to a holder for golf scorecards.

BACKGROUND OF THE INVENTION

Both amateur and professional golfers record their scores on golf scorecards, which may be carried by the golfer's caddy. However, many scorecards are carried by golfers, especially amateurs, and entries are made after each hole. The scorecard may be lost or damaged in handling, and the scorecard is usually not readily accessible to the golfer.

SUMMARY OF THE INVENTION

It is an object of this invention to provide a novel holder for golf scorecards, which may be readily attached to a golf bag, and which effectively retains the golf scorecard for ready access by the golfer.

Another object of this invention is the provision of a golf scorecard formed of transparent plastic, which holds and protects the card, and provides a hard surface upon which the card can be placed for writing.

Another object of this invention is to provide a novel golf scorecard holder formed of transparent plastic, which has a formed clamping element for clamping the scorecard against a surface thereof, and which has an attachment element, which may be readily manipulated for attachment to a golf bag.

These and other objects of the invention will be more fully defined in the following Specification.

FIGURES OF THE DRAWING

FIG. 1 is an exploded perspective of the novel holder for golf scorecards; and FIG. 2 is an end elevational view thereof.

DESCRIPTION OF THE PREFERRED EMBODIMENT

Figures 1, 2:
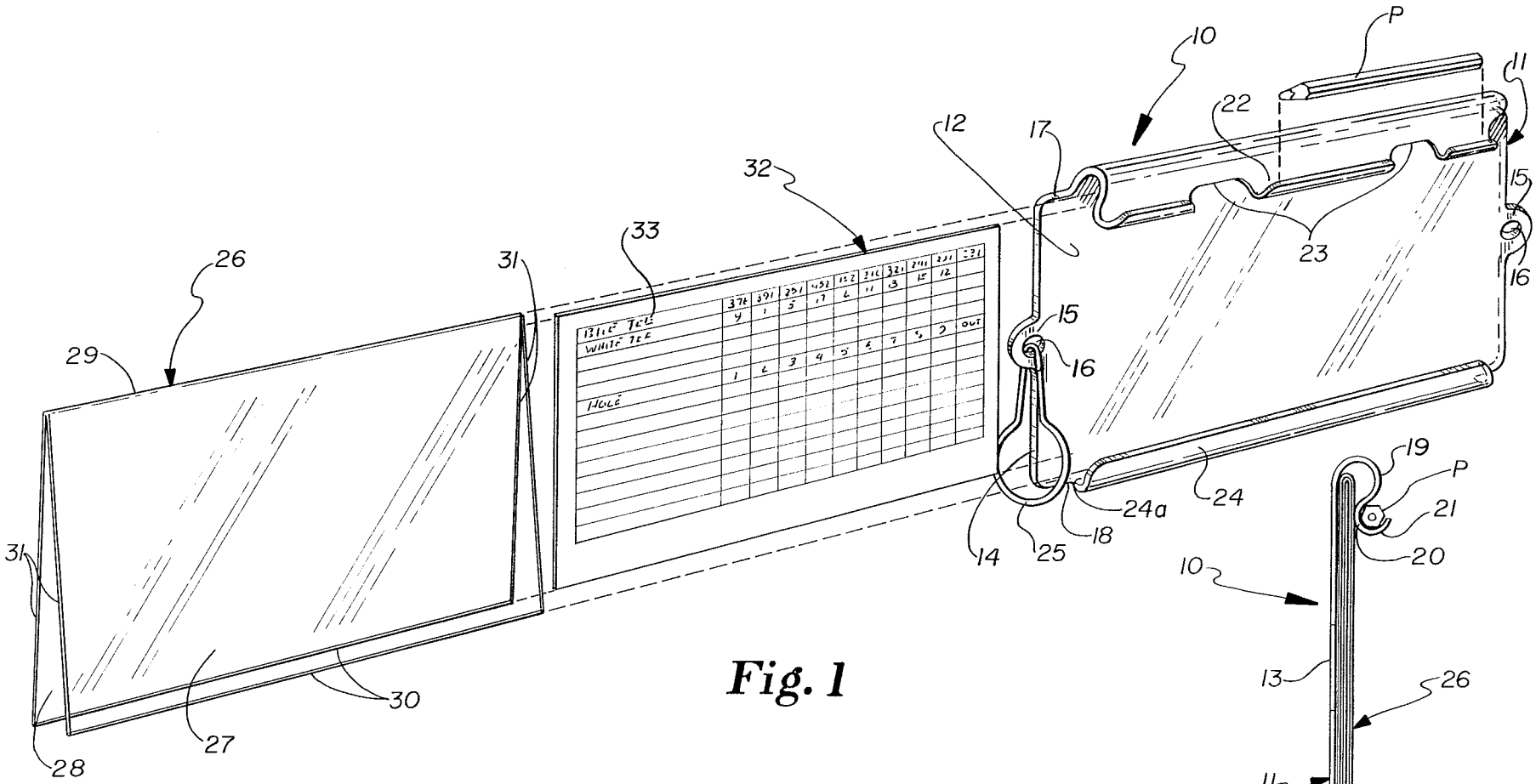

Referring now to the drawings, it will be seen that one embodiment of the novel golf scorecard holder, designated generally by the reference numeral 10, is thereshown. The holder 10 includes a body 11, which is of generally rectangular configuration, and which is formed of a generally rigid transparent plastic. The body 11 includes a substantially flat upper support surface 12 and a substantially flat lower surface 13. The body 11 has a somewhat elongate configuration and includes opposed end edges 14, each provided with a centrally located protuberance 15, which projects outwardly therefrom. Each protuberance has an opening 16 therein.

The body 11 has a longitudinal edge 17, which is disposed in substantially parallel relation with the longitudinal edge 18. The longitudinal edge 17 has an enlarged central part, which is shaped in a molding operation to define a curved portion 19 that extends upwardly, inwardly, and downwardly with respect to the upper support surface 12. The curved portion 19 engages the upper surface of the body to define the curved clamping element 20, which includes a terminal portion 21 that extends first upwardly and then outwardly. A curved terminal portion 21 cooperates with the curved portion 19 to define a clamping recess 22, which is shaped and sized to clampingly engage a pencil P. It will be noted that the terminal portion 21 and the clamping element 22 have a plurality of recesses 23 therein to facilitate removal of a clamped pencil P within the clamping recess 22.

The longitudinal edge 18 of the body 11 also includes an enlarged central part, which is bent upwardly and then inwardly to define a curved lip 24. The curved lip 24 presents an inwardly facing surface **24*a* located opposite the curved portion 19. It will also be noted that the holder 10 includes a metal attachment element 25, which is formed into a generally ring-shaped configuration in which one end portion thereof engages the other end portion thereof in spring-urged relation. One engaged end may be disengaged from the other end portion to permit removal of the attachment element from the opening in the protuberance 15. It is pointed out that the attachment element may be secured to either end of the body 11** to accommodate left-handed and right-handed golfers.

The holder 10 also includes a cardholder envelope 26 formed of transparent flexible plastic and which is of generally rectangular-shaped configuration. The cardholder envelope 26 has length and width dimensions slightly less than the length and width dimensions of the body 11. The envelope includes a substantially rectangular-shaped upper panel 27 and a lower panel 28, which are joined together along one longitudinal edge by a fold line 29. Each panel has a free longitudinal edge 30 and opposed end edges 31. A conventional golf scorecard 32 will be positioned between the panels of the envelope 26 and the golf scorecard 32 will have the typical printing indicia, including the identification or designation of the holes, handicaps, pars, and tees.

In use, the scorecard 32 will be positioned between the panels of the cardholder envelope 26, and the attachment element 25 of the holder will be secured to the golf bag. For example, the takeup buckle on the support strap of the golf bag provides a convenient attachment means for the holder. In this regard, it is pointed out that the golf scorecard holder 10 will be suspended from the golf bag so that the user can readily read the scorecard from left to right. The attachment element will be placed through the opening in one end for right-handed golfers and will be placed at the opposite end for left-handed golfers.

When the cardholder envelope is positioned upon the upper support surface so that the clamping element 20 engages the upper panel 27 of the envelope, the cardholder and envelope will be positively secured to the holder, with little chance of becoming disengaged or dislodged therefrom. The contact between the clamping element 20 and the plastic envelope assures a positive clamping action. It has been found that the clamping element 20 will not clamp as effectively against the surface of a golf scorecard, as against the surface of the plastic panel.

When it is desirable to record a score, the user will merely raise the front panel, make the entry, and thereafter place the free longitudinal edge of the front panel below the curved lip 24. With this arrangement, the scorecard is protected against damage, but is readily accessible for entry of each score.

It will be seen from the foregoing paragraphs that I have provided a novel holder for golf scorecards which can be readily attached to a golf bag at a convenient location for either left-handed or right-handed golf players. It will also be noted from the preceding paragraphs that the scorecard is positively held by the holder and is readily available to a user for entry of score-type data with a minimum of manipulation.

Thus, it will be seen that I have provided a novel golf scorecard holder, which is not only of simple and inexpensive construction, but one which functions in a more efficient manner than any heretofore known comparable scorecard holder.

What is claimed is:

1. A scorecard holder device for attachment to a golf bag, comprising:

a flat generally rectangular-shaped body formed of transparent moldable plastic material and having first and second longitudinal edges and end edges, said body having a clamping surface, said first longitudinal edge portion of said body including a curved portion extending away from said clamping surface and then towards and into engaging relation with the clamping surface to define a clamping element, a terminal portion integral with said clamping element and extending upwardly and outwardly from said clamping surface and cooperating with said curved portion to define an elongate recess shaped and dimensioned for releasably and frictionally engaging a pencil and defining a pencil engaging means, said clamping element and said terminal portion having a plurality of longitudinally spaced apart recesses therein for facilitating removal of the pencil within said pencil engaging means, said second longitudinal edge portion including a curved lip extending upwardly and inwardly with respect to said clamping surface, an elongate generally flat rectangular transparent card containing an envelope including upper and lower panels secured together along a fold line, said envelope having width dimensions only slightly less than the width dimension of said body, a generally rectangular-shaped scorecard positioned between the panels of said envelope, said envelope being positioned upon said clamping surface of said body and engaged along one edge thereof by said clamping element, the opposed edge portion of said envelope positioned within the confines of said curved lip, and means for attaching said body to a golf bag.

2. The device as defined in claim 1 wherein said body has a pair of longitudinally spaced apart openings therein, each hole being located adjacent on end edge of said body, said attaching means comprising a clamping ring extending through one of said openings.

3. The device as defined in claim 1 wherein said clamping element is of curved configuration.

* * * * *